United States Patent [19]

Quesnel

[11] 4,024,494

[45] May 17, 1977

[54] REFRIGERATOR DOOR LOCK WITH ALARM

[76] Inventor: F. Joseph Quesnel, 141 Peacock Drive, Altamonte Springs, Fla. 32701

[22] Filed: June 17, 1976

[21] Appl. No.: 696,948

[52] U.S. Cl. ..... 340/52 R; 340/274 R; 200/61.44

[51] Int. Cl.[2] ..... G08B 21/00

[58] Field of Search ..... 340/52 R, 52 D, 52 F, 340/274 R; 200/44, 61.44, 153 R, 155 R

[56] References Cited

UNITED STATES PATENTS 2,761,121 8/1956 Caporale ..... 340/52 D

*Primary Examiner*—Alvin H. Waring
*Attorney, Agent, or Firm*—Macdonald J. Wiggins

[57] ABSTRACT

A manual positive locking device for doors of refrigerators, freezers and the like that do not have positive door locks such as typically used in motor homes, the locking device having an integral switch connected to an electrical alarm and adapted to be connected to the electrical system of the vehicle such that attempting to start the vehicle with the locking device in the unlocked condition will alert the operator of the unsecured condition. A rotatable T-shaped handle is provided that can be turned to a position that holds refrigerator doors in a tightly closed condition and in such position opens the contacts of the integral switch. The handle can be turned to a position clear of the doors and in such position closes the contacts of the integral switch and thus enables the alarm circuit for initiation when the vehicle ignition switch is turned on.

10 Claims, 18 Drawing Figures

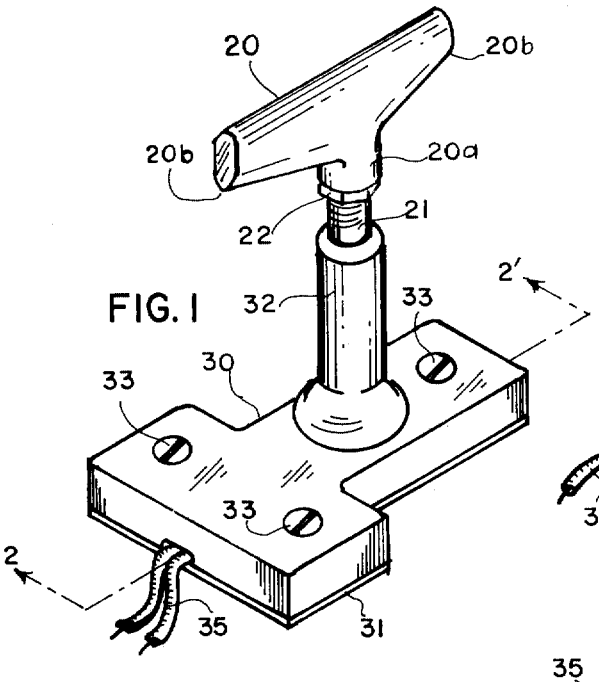
FIG. 1
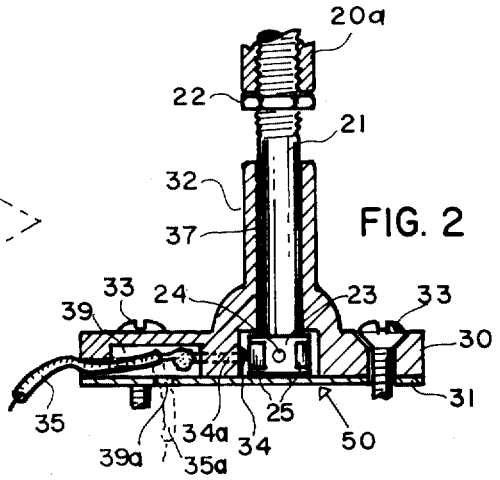
FIG. 2
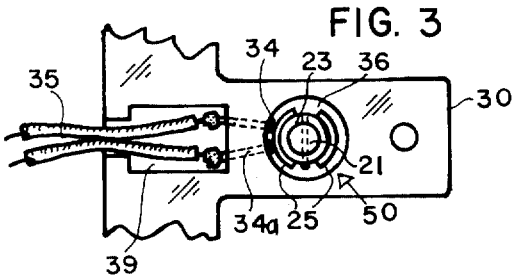
FIG. 3
FIG. 4
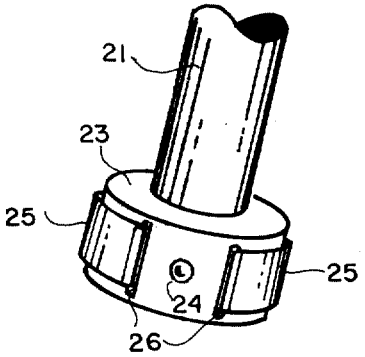
FIG. 5
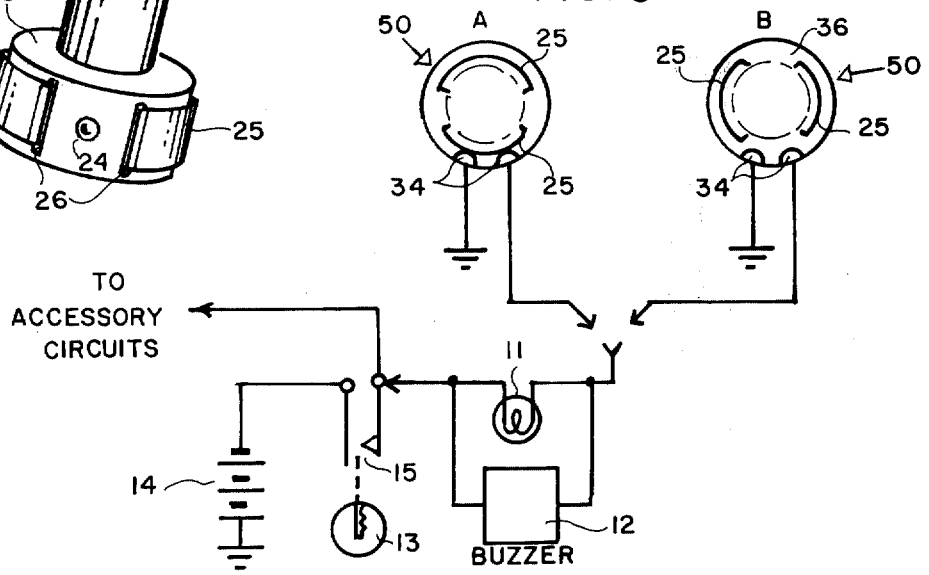

FIG. 6
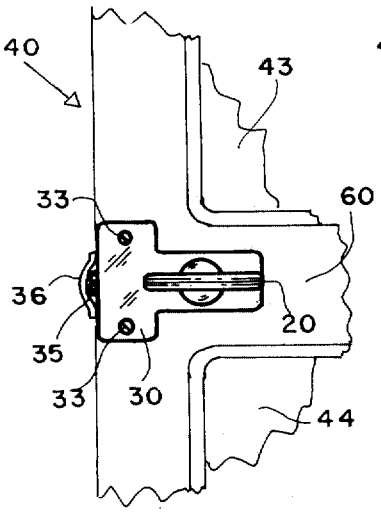
FIG. 7
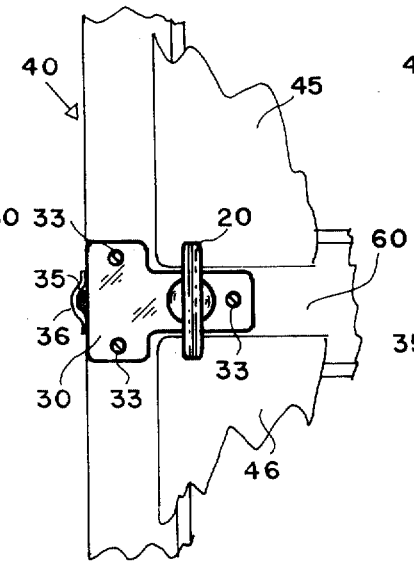
FIG. 8
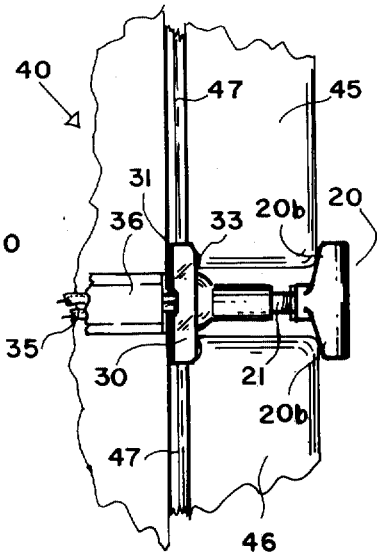
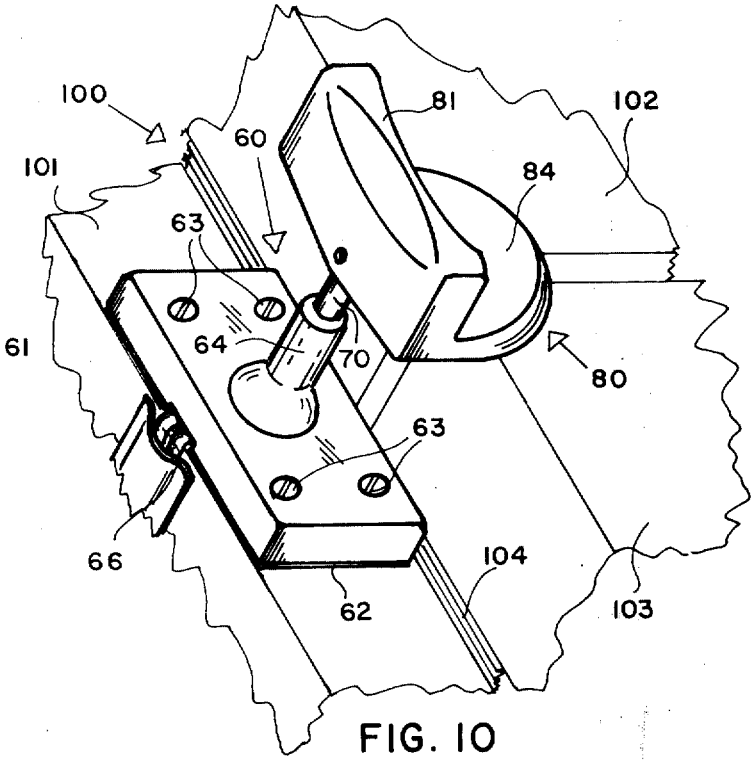
FIG. 10
FIG. 9
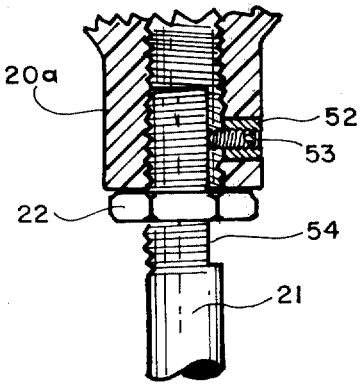

REFRIGERATOR DOOR LOCK WITH ALARM

BACKGROUND OF THE INVENTION

1. Field of the Invention

This invention relates to a door lock associated with a motor home having an alarm circuit for connection to the electrical system of the vehicle to alert the operator prior to movement of the vehicle that the lock is not secured, and more particularly to a motor home refrigerator door lock.

2. Description of the Prior Art

Modern motor homes, camping trailers and other recreational vehicles have refrigerators and freezers installed therein. Due to the close quarters in such vehicles, it is common practice to omit from the refrigerator or freezer the usual door handle and positive lock that might be found on a unit designed for the home. Instead, it is common to provide simple friction or magnetic locks to allow easy access to the refrigerator contents while the motor home is parked, and a locking device that requires an overt manual operation to secure the doors prior to driving the vehicle.

An inherent problem in this arrangement is that the user neglects to apply the manual lock to the refrigerator or freezer door prior to start-up and movement of the vehicle. Thus, it is highly probable that acceleration and turning of the vehicle will cause the doors to swing open with the resulting danger of the contents spilling out onto the floor of the vehicle. Of course, such spillage can, at worst, result in injury to occupants, and at best, waste food and stain carpets.

While door lock alarms are old in the art, no known prior art has approached or solved this problem resulting from the widespread use of recreational vehicles, motor homes, and the like by providing means of warning the operator of such unsafe condition.

SUMMARY OF THE PRESENT INVENTION

My door lock for refrigerators, freezers, and the like includes alarm means to be interconnected with the vehicle electrical system so that operation of the vehicle ignition switch will cause an alarm, thereby alerting the operator that the doors are not locked for driving. Basically, the invention is a simple, low-cost, easily installed manual lock for refrigerator and freezer doors consisting of a locking handle operatively connected with a set of electrical contacts. The contacts are open when the lock is in the correct locked condition and are closed when the lock is in the unlocked condition. Wire leads from the contacts are connected in series with a warning light and buzzer combination, and the accessories contacts of the vehicle ignition switch. Thus, the alarm is initiated when the ignition switch is turned on and the manual lock is unlocked.

Therefore, it is an object of my invention to provide a lock and associated warning signal means for refrigerators and freezers mounted in recreational vehicles, motor homes, and the like which will produce a signal to the vehicle driver when starting that the refrigerator and freezer doors are not securely locked.

It is another object of my invention to provide a manual refrigerator lock that is compact and will not project into the aisles of a recreational vehicle in which it is installed.

It is still another object of my invention to provide a refrigerator door lock for motor home type refrigerators having associated electrical contacts for operating an alarm when the vehicle is started when the door lock is not secure.

It is yet another object of my invention to provide a manually operated refrigerator door lock having a built-in alarm circuit that can be easily installed on an existing motor home refrigerator or the like.

It is a further object of my invention to provide a simple, low-cost manually operated refrigerator door lock having a built-in alarm circuit.

Additional objects and advantages of my invention will become apparent from the following detailed descriptions and drawings.

BRIEF DESCRIPTION OF THE DRAWINGS

FIG. 1 is a perspective view of the lock portion of my refrigerator door lock with integral alarm, FIG. 2 is a cross sectional view of the lock portion of FIG. 1 through section 2–2′ of that figure, FIG. 3 is a bottom view of the body of the lock portion of FIG. 1 with the bottom plate removed to expose the switch contacts, recesses, and wire grooves, FIG. 4 is a perspective view of the rotable switch contacts seen in bottom view in FIG. 3, FIG. 5 is a schematic diagram of the alarm circuit of my refrigerator door lock connected to the ignition switch accessory contacts of a vehicle, FIG. 6 is a fragmentary front view of a refrigerator-freezer having the lock portion of my invention installed thereon and shown in the unlocked condition, with doors open and not shown, FIG. 7 is a fragmentary front view of the refrigerator-freezer of FIG. 6 in which the upper and lower doors are closed and locked by my novel manual refrigerator door lock, FIG. 8 is a fragmentary side view of the refrigerator-freezer of FIG. 7 showing how my manual refrigerator door lock holds the upper and lower doors tightly shut against the door gaskets, FIG. 9 shows a preferred means for permitting adjustment of the length of the lock handle of FIG. 1, FIG. 10 is a perspective view of an alternative embodiment of my alarm lock device installed on a refrigerator.

DETAILED DESCRIPTION OF THE PREFERRED EMBODIMENT

Figure 11:
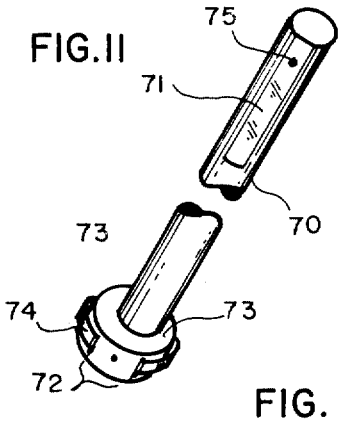
FIG. 11 is a perspective view of the lock shaft assembly of the lock of FIG. 10, showing details of the rotable switch contact.

A preferred embodiment of my refrigerator door lock for refrigerators and freezers installed in motor homes and the like is shown in perspective view in FIG. 1. The lock element comprises a body 30, a bottom plate 31, a lock handle 20 and a lock shaft 21. The base of body 30 is generally T shaped to fit on a mullion between refrigerator/freezer doors as illustrated in FIGS. 6, 7 and 8. Body 30 may be made from any suitable material although I prefer a plastic material such as Lexan, nylon or the like. A shaft bearing portion 32 of body 30 carries lock shaft 21, best seen in the sectional view of FIG. 2. Shaft 21 may be of steel or other metal and has its outer end threaded to receive locking nut 22 and the hub 20*a* of lock handle 20. The position of handle 20 on shaft 21 can be adjusted as will be explained in detail below. Lock handle 20 forms a T shape with lock shaft 21 having an outward taper on the underside of handle 20 from the hub 20*a* to the outer ends 20*b*.

Turning to the cross sectional views of FIG. 2 and FIG. 3, details of switch 50 are shown. A cylindrical shaft bearing portion of body 30 is shown with concentric opening 37 which serves as the bearing for shaft 21. At the bottom end of opening 37 is a cylindrical recess 36 and concentric with opening 37. The lower end of shaft 21 has a cylinder 23 insulating materials attached by means of pin 24 passing through cylinder 23 and shaft 21. The preferred construction of cylinder 23 is shown in the perspective view of FIG. 4. Two arcuate contact strips 25 of spring brass, phosphor bronze or similar material are disposed in slots 26 in cylinder 23. As may be noted in FIG. 3, each strip 25 covers an angle of about 165° and the strips 25 are oppositely disposed. Strips 25 serve as conductive contacts to bridge across two contact points 34 with the slight springiness of strips 35 providing positive contact with points 34. Contact points 34 may be formed by the heads of two brass rivets 34*a* pressed into the wall of recess 36 and extending into groove 39 in body 30. A pair of wires 35 are electrically connected to the rivets 34*a* and dressed out from the base in the channel formed by groove 39 and bottom plate 31. For some installations, wire leads 35 may be dressed through opening 39*a* in base plate 31 as shown in phantom view as leads 35*a*.

As may now be understood, rotation of lock shaft 21 will cause one of contact strips 25 to bridge across the two contact points 34 of switch 50, thereby closing an electrical circuit. When shaft 21 is rotated to place either of the peripheral segments of cylinder 23 not covered by contact strips 25 adjacent to contact points 34, such electrical circuit will be in an open or nonconductive condition. The provision of two oppositely disposed contact strips and two oppositely disposed non-contact areas allows the user to rotate lock handle 20 in either direction without negating the alarm action.

The connections of the switch 50 thus formed by contact strips 25 and contact points 34 with the other elements of my invention to form an alarm is shown schematically in FIG. 5. Switch 50 is connected in series with lamp 11 and buzzer 12 in parallel connection, and with ignition switch contacts 15 to the terminal of vehicle battery 14, with the vehicle ground furnishing the return path between battery 14 and switch 50. Switch contacts 15 are the usual "accessory" contacts of ignition switch 13 and are not to be understood as part of my invention. When switch 50 is in the open position shown in detail A, the ignition switch 13 can be turned on without causing lamp 11 and buzzer 12 to be operated. However, if switch 50 is in closed position as shown in detail B, indicative of an unlocked condition of the refrigerator doors, then in accordance with my invention, lamp 11 will light and buzzer 12 will sound, alerting the driver of the unsafe condition. Lamp 11 may be any suitable lamp preferably mounted in a conspicuous spot on the vehicle instrument panel, and buzzer 12 may be any type of audible warning device.

Turning now to FIGS. 6, 7 and 8, a typical installation of my novel refrigerator lock and alarm is shown. The refrigerator 40 includes an upper compartment 43 and a lower compartment 44 separated by mullion 60. In FIG. 6, a fragmentary front view of refrigerator 40 is given with the doors to compartments 43 and 44 assumed open and not shown. Body 30 of my door lock is mounted by mounting screws 33 to center the handle 20 on mullion 60. Leads 35 are dressed around the left corner of refrigerator 40 and rearwardly along left side 41. A plastic covering 36 may be installed along side 41 to cover leads 35 for protection thereof and for improving the appearance of the installation.

Handle 20 in FIG. 6 is shown parallel with mullion 60 allowing the doors (not shown) to be freely opened and closed. In the fragmentary front view of refrigerator 40 of FIG. 7, upper door 45 and lower door 46 are shown closed with handle 20 rotated 90° from the position of FIG. 6, with the underside of handle 20 contacting the lower edge of upper door 45 and the upper edge of lower door 46, thereby securing doors 45 and 46 from opening.

The fragmentary side view of refrigerator 40 to be seen in FIG. 8 illustrates more specifically the locking action of handle 20. As doors 45 and 46 are closed, gaskets 47 of a compressible material bear on the door mullions. The tapered configuration of handle 20 allows the tip ends 20*b* of the handle 20 as it is rotated to slide over the door edges with gaskets 47 uncompressed, and as handle 20 continues to rotate, causes compression of gaskets 47. When handle 20 is vertical as shown, considerable tension from the compressed gaskets 47 holds the doors 45 and 46 tightly locked in accordance with my invention.

Handle 20 is oriented on lock shaft 21 so that switch 50 is in the open condition when in the locked position of FIG. 7 and in the closed condition in the unlocked position of the handle 20 in FIG. 6.

As may be understood, to make my refrigerator door lock adaptable to various models and types of refrigerators, the length of shaft 21 with respect to handle 20 must be adjustable. FIG. 9 shows a preferred arrangement for this purpose. Shaft 21 is threaded at its outer end and has a flat surface 54 provided on one side. The hub 20*a* of handle 20 is threaded to fit the threads of shaft 21. A threaded metal bushing 52 is disposed in the hub 20*a* of handle 20 to accept set screw 53. To adjust handle 20, locking nut 22 is loosened and set screw 53 is backed out allowing handle 20 to be screwed up or down on the threaded end of shaft 21. When the adjustment is completed so as to obtain the desired locking tension on the refrigerator doors, a minor adjustment is made to bring bushing 52 adjacent the flat 54 of shaft 21 and set screw 53 tightened against flat 54. Locking nut 22 is then tightened against the hub 20*a* of handle 20.

As previously discussed, cylinder 23 is secured to shaft 21 by pin 24. It may now be recognized that the orientation of cylinder 23 on shaft 21 with respect to flat 54 is selected such that switch 50 is in the open condition with handle 20 in the locked position on refrigerator 40 as shown in FIG. 7. Lock handle 20 may be rotated 180° and still perform its locking function. It is for this reason that I have provided two contact strips 25 on cylinder 23 so that my alarm circuit is operative for either position of handle 20.

While many materials are suitable for the construction of lock handle 20, I prefer to use a strong plastic such as Lexan or nylon. The bottom plate 31 is preferably formed from an insulating material such as plastic, bakelite or the like.

DETAILED DESCRIPTION OF AN ALTERNATIVE EMBODIMENT

The preferred embodiment of my invention described hereinabove is applicable to many popular types of refrigerator-freezers used in motor homes. However, there are other designs which have very closely spaced doors and there is not sufficient space to mount the alarm lock device 5 between the doors as shown in FIG. 6. I will now describe an alternative embodiment of my novel alarm lock that is suitable for attaching to refrigerators of such design.

Turning to FIG. 10, a perspective view of this version 60 of my invention is shown mounted on a refrigerator-freezer 100 having an upper door 102 and a lower door 103. For purposes of clarity of viewing the alarm lock element 60, the viewpoint is as if the refrigerator 100 were tipped on its back, which is not to be considered the normal operating position. Alarm lock element 60 consists of a body portion 61, bottom plate 62, lock shaft 70, and a lock handle 80. The body 61 differs from the previously-described body 30 of FIG. 1 only in its shape, being of a generally rectangular base portion which may be 1 inch by 2½ inches and having a shaft bearing portion 64 corresponding to shaft bearing portion 32 of FIG. 1. A switch assembly, not seen in FIG. 10 is contained within body 61 and operated by shaft 70 in a similar fashion as switch 50 of the preferred embodiment, and explained in more detail below.

Figure 11A:
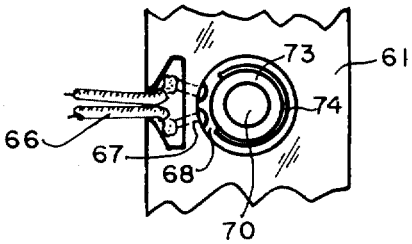
FIG. 11*a* is a fragmentary view of the rotable switch contact and the lock body, showing details of the stationary switch contacts.

Lock shaft 70, as shown in FIG. 11, includes a cylinder 73 of insulating material attached at its inner end. An arcuate contact strip 74 formed from spring brass, phosphor bronze or the like, covers approximately 315° of the periphery of cylinder 73 and may be mounted in suitable slots cut into the peripheral surface so as to form a contact surface biased in a radial direction. An approximate 45° non-conducting surface 72 is thus formed on the periphery of cylinder 73 between the ends of strip 74. A flat surface 71 is milled on the outer end of shaft 70 and aligned with the non-conducting surface 72. Hole 75 is drilled near the outer end through flat surface 71 for attachment of the lock handle 80. The manner in which contact strip 74 is utilized may be seen with reference to FIG. 11*a* which shows a section of body 61 through the switch area. Rivet-like brass contacts 67 are disposed in cylindrical recess 68 which is concentric with cylinder 73. When the shaft 70 is in the position shown no contact is made across contacts 67. However, contact strip 74 bridges contacts 67 when shaft 70 is rotated slightly less than 45°. Leads 66 attached to contacts 67 serve to connect the switch assembly to the vehicle and alarm circuit in the same manner as previously described with reference to the preferred embodiment.

Figure 12:
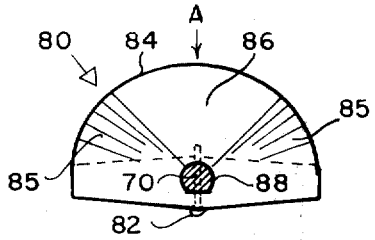
FIG. 12 is a bottom view of the lock handle of the lock of FIG. 10.
Figure 13:
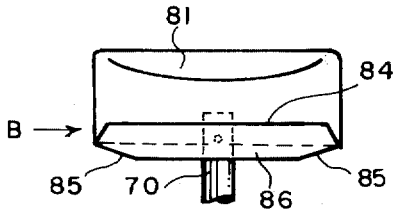
FIG. 13 is a front view of the lock handle.
Figure 14:
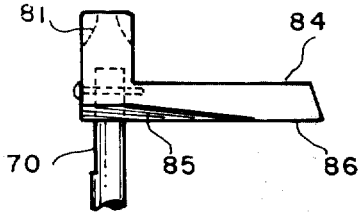
FIG. 14 is a side view of the lock handle.

The lock handle 80 is shown in detail in FIGS. 12, 13 and 14 with FIG. 12 being a bottom view of handle 80. An opening 88 is formed corresponding to the size of shaft 70 and having a flat surface therein to form a snug fit in shaft 70. A pin 82 is pressed into the side of handle 80 through hole 75 in shaft 70, securely locking the handle 80 to shaft 70 in its required relationship. The bottom view of handle 80 discloses a semi-circular portion 84 that is seen also in FIG. 10 whose underside 85, 86 serves to contact the outer surfaces of the refrigerator doors 102 and 103. As may now be seen, portion 84 serves to maintain doors 102 and 103 securely locked in when in position 84*a* of FIG. 10. When the handle 80 is rotated 180° to position 84*b*, shown in phantom view in FIG. 10, the doors 102 and 103 will be free to open.

As shown in FIG. 12, 13, and 14, the under surface of portion 84 is slightly relieved or tapered as at 85 to allow the underside of portion 84 to slide over the door edges and to allow flat area 86 to contact the doors and compress gaskets 104 ensuring a tight friction lock.

FIG. 13 is a view in the direction A of FIG. 12, and FIG. 14 is a view in the direction B of FIG. 13, each Figure revealing additional details of handle 80 and showing more clearly the desired tapered areas 85. Also shown is hand grip 81 which projects outward and normal to portion 84 and may be molded to provide a convenient gripping surface to the user.

Figure 15:
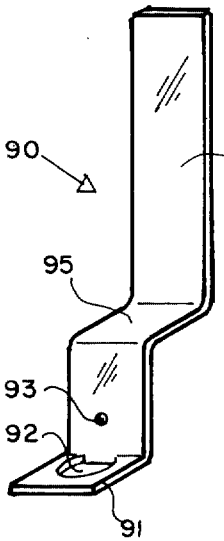
FIG. 15 is a perspective view of an adjustment guide for adjusting the length of the lock shaft.

It may be recognized that the locking action of lock handle 80 depends on the length of shaft 70 being selected to provide sufficient compression of the door gaskets 104 when in the locked position. Since all refrigerators do not have the same thickness doors, I have provided a convenient method of matching my lock element 60 to a particular refrigerator at time of installation of the lock element. At time of manufacture, shaft 70 is made in a length longer than required for the greatest door thickness expected, and hole 75 is not drilled. The length of shaft 70 is then determined at the time of installation, excess length cut off, and hole 75 drilled in the correct position. To allow the installer to make this determination, I provide an expendable adjustment guide 90 shown in FIG. 15 comprising a strip of light metal having a right angle bend 91 at one end. The bent end 91 has opening 92 which will fit snugly over the flat-sided outer end of shaft 70. A drill guide hole 93 is disposed just above bent end 91. Above hole 93, the strip is bent in a step shape 95 leaving a guage end 94.

Figure 16:
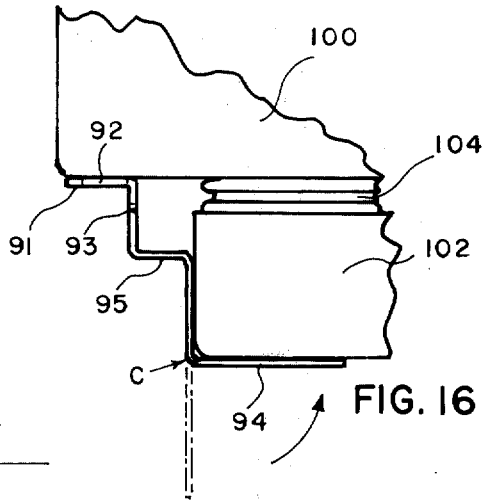
FIG. 16 is a fragmentary view of a refrigerator showing the guide being set.

FIG. 16 illustrates how guide 90 is set for a particular refrigerator 100 seen in top view. End 91 is held against outer mullion 101 of refrigerator 100 and guage end 94 is firmly held against the outer edge of door 102. The free end of guage end 94 is bent as shown by the arrow at right angles at point C to conform to the face of door 102. As may be seen, the distance from bent guage end 94 to end 91 is then a measure of the door 102 thickness plus the uncompressed gasket 104 thickness. At this point, guide 90 is temporarily installed on the body and shaft assembly of lock element 60.

Figure 17:
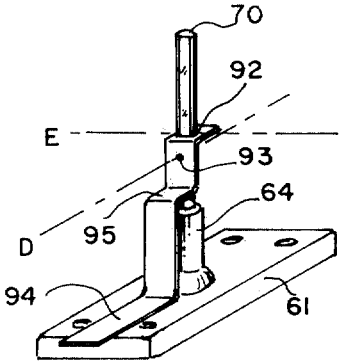
FIG. 17 is a perspective view of the set guide of FIG. 16 in use to adjust the lock shaft.

As shown in FIG, 17, the set guide 90 is placed over shaft 70 through its opening 92. Bent guage end 94 is next held firmly on the flat surface of body 61 with step shape 95 clearing shaft bearing portion 64. Drill guide hole 93 is against the flat surface 71 of shaft 70 and provides a guide for drilling hole 75 as at D in FIG. 17. After drilling hole 75, shaft 70 is cut off at point E, using end 91 as a guide. After adjustment is complete, guide 90 may be discarded. The hole 93 position has been selected so that installation of handle 80 and pin 82 on shaft 70 will result in the correct compression of gaskets 104 when handle 80 is in the locked position.

As illustrated in FIG. 10, alarm lock element 60 can be mounted on the outside mullion 101 of a refrigerator or the like. However, in some manufacturer's models, the door edges are flush with the side of the box when closed. Thus, there is no convenient mounting surface. In such cases, I prefer to use a simple angle bracket with one face matching in size the base 61 of the lock element 60. The base 61 is bolted to the bracket with screws 63 and the bracket attached to the side of the box so as to bring the lock handle portion 84 in the proper position relative to the door faces to perform its locking function.

APPLICATION

Having described a preferred embodiment and an alternative embodiment of my novel refrigerator door lock with alarm circuit in detail, the application of the devices will be explained. As previously discussed, the primary use foreseen is in mobile homes, camping trailers, recreational vehicles and other vehicles in which there is a danger of spillage of the contents of unlocked storage elements, with application to refrigerators and freezers the most common. The lock elements can be added to most existing refrigerators/freezers and can be modified to fit other equipment such as pantries, utensil storage cabinets, filing cabinets and the like. It is, of course, eminently practical to install a version of my alarm lock at time of manufacture of equipment to which it may be applied.

After physical installation of the lock element on a refrigerator or other cabinet, one of the contact switch leads is grounded to the vehicle chassis and the other lead is connected in series with the warning device and the accessory contact on the vehicle ignition switch, thereby providing warning to the driver when an attempt is made to start the vehicle and the lock is not secured.

While I have described two embodiments of my invention, it is obvious that many variations in construction will occur to those skilled in the art. For example, the contact switch can utilize many types of electrical contacts well-known in the art in place of the low-cost preferred contacts. Similarly, a preassembled switch of the snap-action type can be used with a cam arrangement on the rotable handle serving to operate the switch. Therefore, I consider that such modifications fall within the spirit and scope of my invention.

I claim:

1. A lock and alarm device for attachment to refrigerators, freezers, cabinets and the like installed in recreational-type vehicles for securing the doors of such refrigerators, freezers, cabinets and the like in which an alarm will occur when such doors are not secured and the vehicle engine is started, comprising:

friction lock means mountable adjacent to at least one door, said means having a manually operable handle, said handle adapted to contact the front surface of the door in a first position, such contact serving to hold the door securely closed, and to clear the door in a second position allowing the door to be opened;

electrical contact means operatively connected to said handle and arranged to be in a closed position when said handle is in the second position, and to be in an open condition when said handle is in the first position; and electrical alarm signal means connected in series with said electrical contact means and connectable to the ignition switch of the vehicle, thereby forming a series circuit consisting of the vehicle battery, said electrical contact means, said signal means, and the ignition switch; whereby said alarm signal means is energized when said lock is in the second position at a time when the ignition switch is closed.

2. The device as defined in claim 1 in which said friction lock means includes a body portion having mounting means and a lock shaft disposed in said body and attached to said handle, said handle being rotable approximatedly 90° between the first position and the second position.

3. The device as defined in claim 2 in which said lock shaft includes adjustment means for adjusting the length of said shaft with respect to said handle.

4. The device as defined in claim 3 in which said adjustment means comprises external threads in the outer end of said shaft, said shaft having a flattened area thereon, said handle having internal threads for threadedly attaching said handle to said shaft, a lock nut threaded on said shaft for locking said handle in a selected position on said shaft, and a set screw threadedly inserted in said handle for engaging said flattened area for correctly indexing said handle with respect to said contact means.

5. The device as defined in claim 3 in which said adjustment means comprises a pin for securing said handle to said shaft and gauging means for determining the correct location of said pin with respect to said shaft and the correct length of said shaft.

6. The device as defined in claim 2 in which said electrical contact means includes a rotable conductive portion attached to said lock shaft and a pair of stationary contacts having electrical leads connected thereto, said conductive portion arranged to form the closed contact condition between said pair of stationary contacts when said handle is rotated to the second position and the open contact condition between said pair of stationary contacts when said handle is rotated to the first position.

7. The device as defined in claim 1 in which said electrical alarm signal means is an audible alarm.

8. The device as defined in claim 1 in which said electrical alarm signal means is a visual signal.

9. The device as defined in claim 1 in which said handle is generally T-shaped having a tapered underside serving to contact the front surface of the door in the first position, said tapered underside arranged to contact the edge of the door as said handle is manually rotated from the second position toward the first position and to progressively urge the door to a tightly closed condition with maximum tightness occurring in the first position.

10. The device as defined in claim 7 in which said T-shaped handle includes an approximately semi-circular portion for contacting the front surface of the door.

* * * * *